US009271625B2

(12) United States Patent
Colangelo

(10) Patent No.: US 9,271,625 B2
(45) **Date of Patent: *Mar. 1, 2016**

(54) CLEANING DEVICE

(71) Applicant: Joseph M Colangelo, Delray Beach, FL (US)

(72) Inventor: Joseph M Colangelo, Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/689,015

(22) Filed: Apr. 16, 2015

(65) Prior Publication Data

US 2015/0216387 A1 Aug. 6, 2015

Related U.S. Application Data

(63) Continuation of application No. 14/296,459, filed on Jun. 5, 2014, now Pat. No. 9,032,577, which is a continuation of application No. 13/685,381, filed on Nov. 26, 2012, now Pat. No. 8,776,300, which is a continuation-in-part of application No. 29/418,019, filed on Apr. 11, 2012, now Pat. No. Des. 674,566.

(51) Int. Cl.

| | |
|---|---|
| ***A47L 13/16*** | (2006.01) |
| ***A47L 13/17*** | (2006.01) |
| ***A47L 13/20*** | (2006.01) |

(52) U.S. Cl.
CPC ..... *A47L 13/16* (2013.01); *A47L 13/17* (2013.01); *A47L 13/20* (2013.01)

(58) Field of Classification Search
CPC ..... A47L 13/16; A47L 13/17
See application file for complete search history.

(56) References Cited

U.S. PATENT DOCUMENTS

| | | | | |
|---|---|---|---|---|
| 6,048,123 | A * | 4/2000 | Holt et al. | 401/138 |
| 6,101,661 | A | 8/2000 | Policicchio et al. | |
| 6,601,261 | B1 | 8/2003 | Holt | |
| 6,766,552 | B1 | 7/2004 | Policicchio et al. | |
| 8,337,110 | B2 * | 12/2012 | Rees et al. | 401/261 |
| D674,566 | S | 1/2013 | Colangelo | |
| 8,776,300 | B2 | 7/2014 | Colangelo | |
| 2014/0283322 | A1 | 9/2014 | Colangelo | |

* cited by examiner

*Primary Examiner* — Randall Chin
(74) *Attorney, Agent, or Firm* — Smith Risley Tempel Santos LLC; Gregory Scott Smith

(57) ABSTRACT

A cleaning cloth constructed of an upper sheet and lower sheet that are joined together for form an interior cavity into which additional cleaning cloths, cleaning materials, abrasive materials, scented materials, etc. can be placed. The cleaning cloth includes strips that can be used to connect the cleaning cloth to a mop head or other surface.

16 Claims, 7 Drawing Sheets

CLEANING DEVICE

This is a utility patent application being filed in the United States as a non-provisional application for patent under Title 35 U.S.C. §100 et seq. and 37 C.F.R. §1.53(b) as a continuation application of United States Application for Patent filed on Jun. 5, 2014 and assigned Ser. No. 14/296,459 and which issued as U.S. Pat. No. 9,032,577 on May 19, 2015, which is a continuation application of United States Application for Patent filed on Nov. 26, 2012 and assigned Ser. No. 13/685,381 and issued as U.S. Pat. No. 8,776,300 on Jul. 15, 2014, which application is a continuation-in-part of design Application No. 29/418,019, filed Apr. 11, 2012 and issued as U.S. Pat. D674566 on Jan. 15, 2013, which applications are incorporated herein by reference in their entirety.

BACKGROUND

From the beginning of time, man has had a special relationship with dust. As set forth in Genesis 3:19, the Creator is quoted as saying "In the sweat of thy face shalt thou eat bred, till thou return unto the ground; for out of it wast thou taken: for dust thou art, and unto dust shalt thou return". And thus, ensues the never-ending battle between man and dust. Maybe our fixation with cleanliness is an attempt to combat our own mortality. Maybe we believe that if we eradicate the dust from our life, from our presence, and we distance ourselves from the dust, then maybe, just maybe it will prolong our separation from the same and thus, delay our return to dust. Regardless of the cause, it is clear that in our modern day society, dust and dirt are simply not acceptable and as such, a multi-billion dollar industry thrives on creating products to help us control and remove the dust from our lives.

In recent years, the cleaning industry has been flooded with a variety of disposable cleaning products. These disposable cleaning products have ranged from handheld wipes to handled wipes and even attachments to brooms or mop handles. In the quest to eradicate dust and grime, the industry continues to seek out and create the ideal disposable cleaning pad or cleaning cloth that can rigorously attack tough tasks, break through dirt and grime, and provide a nice clean surface. Thus, there is a need in the art for an improved cleaning cloth.

BRIEF SUMMARY

Various embodiments of a cleaning cloth including, features, elements, functions, and aspects thereof are presented within this description. In one embodiment, the cleaning cloth includes an upper sheet having a length and a width and a lower sheet having a length and width corresponding to the length and width of the upper sheet. The upper sheet and lower sheet can be joined together to form an interior cavity. One or more interior sheets can then be inserted into the cavity. In some embodiments, the one or more interior sheets cause an interior portion of the upper sheet and an interior portion of the lower sheet to be defined by a ridge that transitions to a ledge corresponding to the edge of the one or more interior sheets.

In some embodiments, at least two interior sheets are inserted into the cavity and the length and width of the interior sheets are equal. In some embodiments, two interior sheets may further have the same thickness.

One embodiment includes a cleaning cloth that has an upper sheet having a length and a width and a lower sheet having a length and width corresponding to the length and width of the upper sheet. The upper sheet and lower sheet are joined together to form an interior cavity. One or more interior sheets can be inserted into the cavity and the one or more interior sheets cause an interior portion of the upper sheet and an interior portion of the lower sheet to be defined by a ridge that transitions to a ledge corresponding to the edge of the one or more interior sheets. In some embodiments, the lower surface of the cleaning pad has a uniformly textured surface. In other embodiments, the upper surface of the cleaning pad features one or more uniformly longitudinal woven attachment strips.

In various embodiments, the interior sheet material may include or be constricted of an absorbent air-laid substrate, substantially made of cellulosic wood pulp fibers. In the various embodiments, the total basis weight of absorbent material from the one or more interior absorbent sheets is from about 200 grams to about 400 grams per square meter although this range can expand or contract depending on materials.

In some embodiments, the length and width of at the at least two interior sheets are equal and further, in some embodiments, the at least two interior absorbent sheets have the same thickness.

In some embodiments a cleaning solution can be placed within the cavity. In some embodiments, a scented material can be placed within the cavity. In yet other embodiments, the interior sheets may be impregnated, doused, saturated or otherwise affiliated with the cleaning solution and/or scented material.

DETAILED DESCRIPTION OF EMBODIMENTS

The present disclosure is directed towards various embodiments of a cleaning cloth, as well as features and aspects of the new cleaning cloth. In one embodiment, the cleaning cloth includes two external sheets that are joined together in a sandwiched configuration. The two external cloths may be used to enclose one or more internal sheets. In a particular embodiment, the cleaning cloth includes two external sheets with two sheets of absorbent material sandwiched there between and attachment strip(s) placed along at least one surface of the cleaning cloth. Now turning to the figures, the various embodiments, features, elements and aspects are more fully described.

Figure 1:
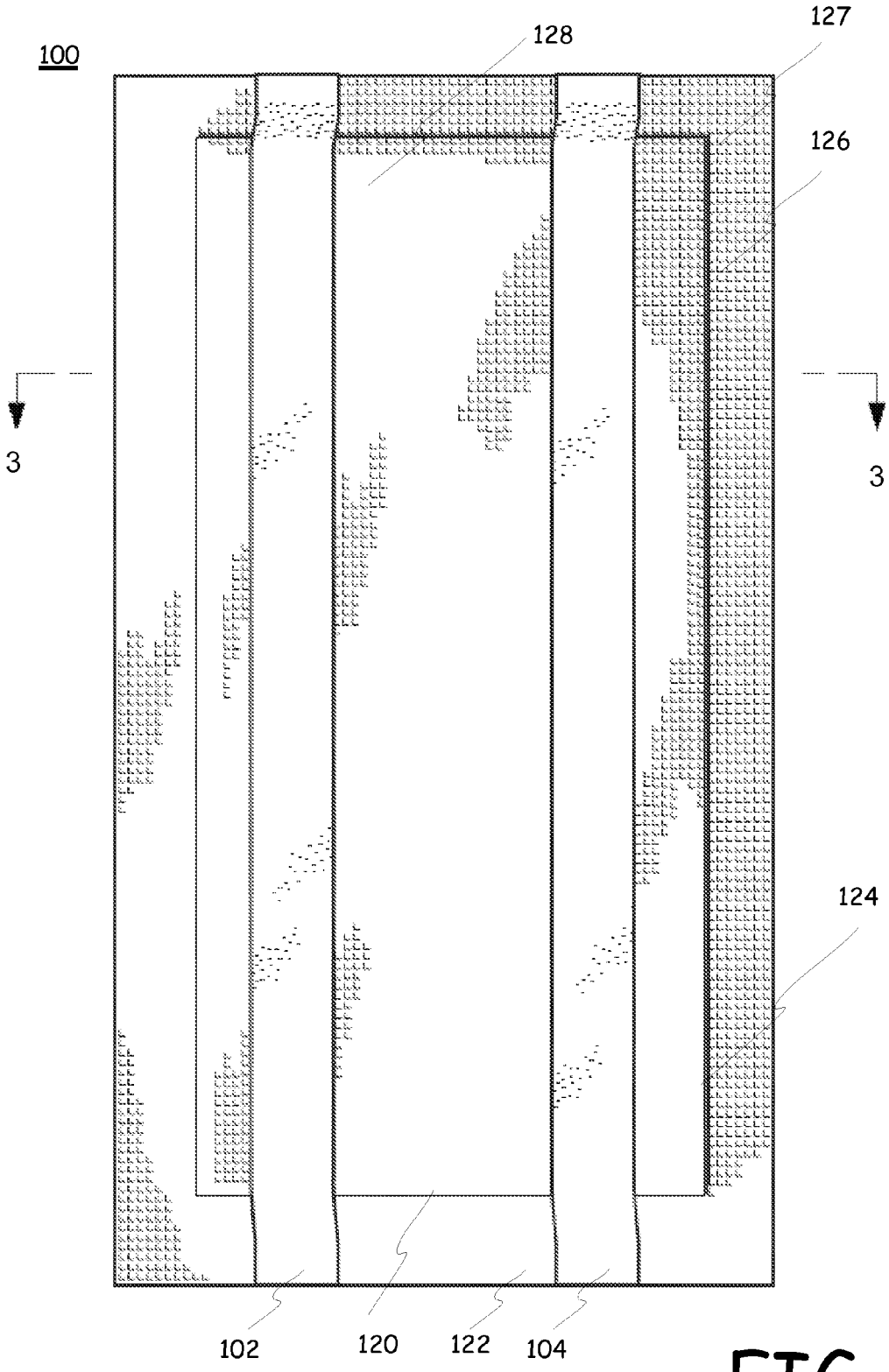
FIG. 1 is a top plan view of the cleaning cloth.

FIG. 1 is a top plan view of the cleaning cloth. The cleaning cloth 100 is shown as including a top sheet 120 with a first strip 102 that extends the longitudinal length of the top sheet 120 and a second strip 104 that extends the longitudinal length of the top sheet 120. It should be appreciated that in some embodiments, the strips may not extend the entire length of the top sheet 120 and in other embodiments, the strip may be broken into multiple segments. Further, although the strip is shown as having two straight and parallel edges in the longitudinal direction, the strips may also be curved, arched, include undulations, zigzagged, etc.

The top sheet 120 is illustrated as being textured 127, however, it will be appreciated that the illustrated texture is just one non-limiting example of a texture and, any of a variety of textures or surfaces could be utilized in the various embodiments of the cleaning cloth. The top sheet 120 is illustrated as having a rectangular shaped interior portion 128, and an exterior border or ledge 122 that extends around the periphery of the interior portion 128. A ridge 124 is shown as existing at the junction of the interior portion 128 and the ledge 122 which basically defines a transition from a thicker portion of the cleaning cloth 100 to a thinner portion as is shown in more detail below. The first strip 102 and the second strip 104 are illustrated as extending from the surface of the interior portion 128, across the ridge 124 and onto the surface of the ledge 122. Although as previously described, in some embodiments the strip may fall short of the ledge 122 or may extend partly across the width of the ledge 122 or entirely across the width of the ledge 122 as illustrated.

Figure 2:
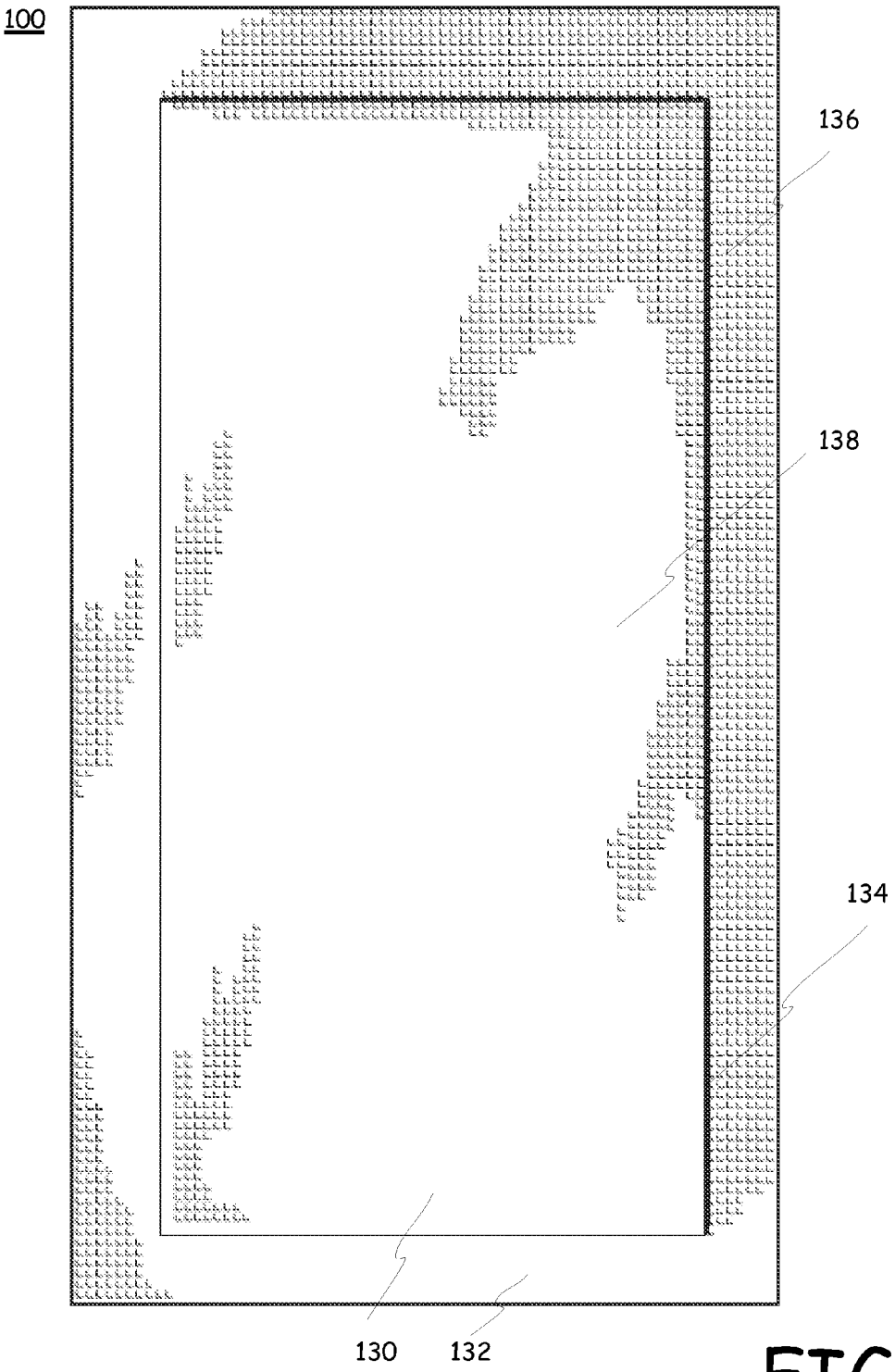
FIG. 2 is a bottom plan view of the cleaning cloth illustrated in FIG. 1.

FIG. 2 is a bottom plan view of the cleaning cloth illustrated in FIG. 1. In this figure, a bottom sheet 130 of the cleaning cloth 100 is illustrated as including a ledge 132 that transitions at ridge 134 to an interior portion 138. Similar to the top side illustrated in FIG. 1, the interior portion 138 stands higher, or is thicker than the ledge 132 portions as further described below. Similar to the top side illustrated in FIG. 1, the surface of the bottom sheet 130 can be textured 136, as illustrated or textured in any of a wide variety of other manners or, not textured at all in some embodiments.

The upper sheet and lower sheet may be constructed of a variety of materials including cotton, superabsorbent materials, gauze like material, cheesecloth, non-woven fiber sheets, etc. The texture on the top and bottom sheets may range from smooth, fine, medium to course and extra course. Thus, depending on the particular use of the cleaning cloth, different textures may be utilized.

Figure 3:
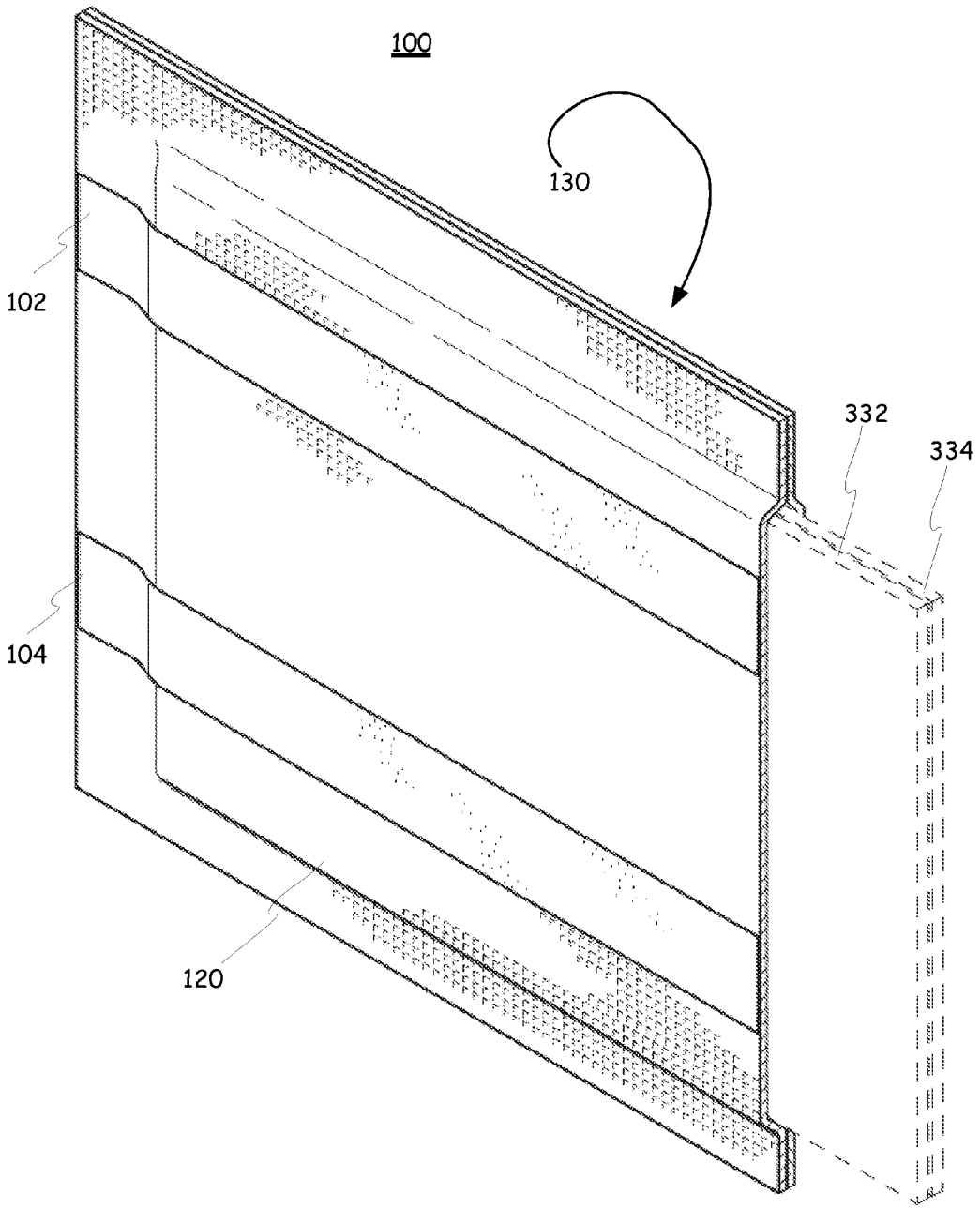
FIG. 3 is a perspective view of the cleaning cloth illustrated in FIG. 1 with a cross-section proximate to line 3 as illustrated in FIG. 1.

FIG. 3 is a perspective view of the cleaning cloth illustrated in FIG. 1 with a cross-section proximate to line 3 as illustrated in FIG. 1. In the illustrated embodiment, the cleaning cloth 100 is shown as housing a plurality of interior sheets 332 and 334 sandwiched between the top sheet 120 and the bottom sheet 130. The interior sheets are of the same length and width but, may have varying thickness. In fact, in some embodiments, the thickness may vary from one interior sheet to the next and, in other embodiments, even the thickness across a single sheet may vary. For instance, the thickness may vary between 1% to 25% on some embodiments. The interior sheets have the same length and width such that the ridges 124 and 134 have a clean and sharp transition from the interior portions 128 and 138, to the ledges 122 and 132 respectively.

The thickness of the interior sheets 332 and 334 is shown as being thicker than the upper sheet 120 and the lower sheet 130 but, in other embodiments, the thickness may be the same or thinner.

Figure 4:
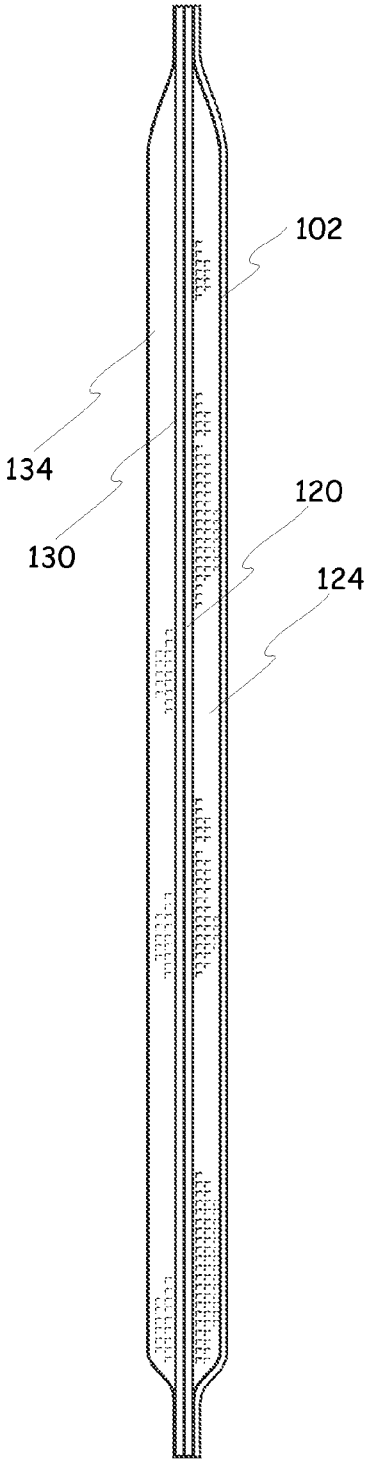
FIG. 4 is a first side elevation view of the cleaning cloth illustrated in FIG. 1.
Figure 5:
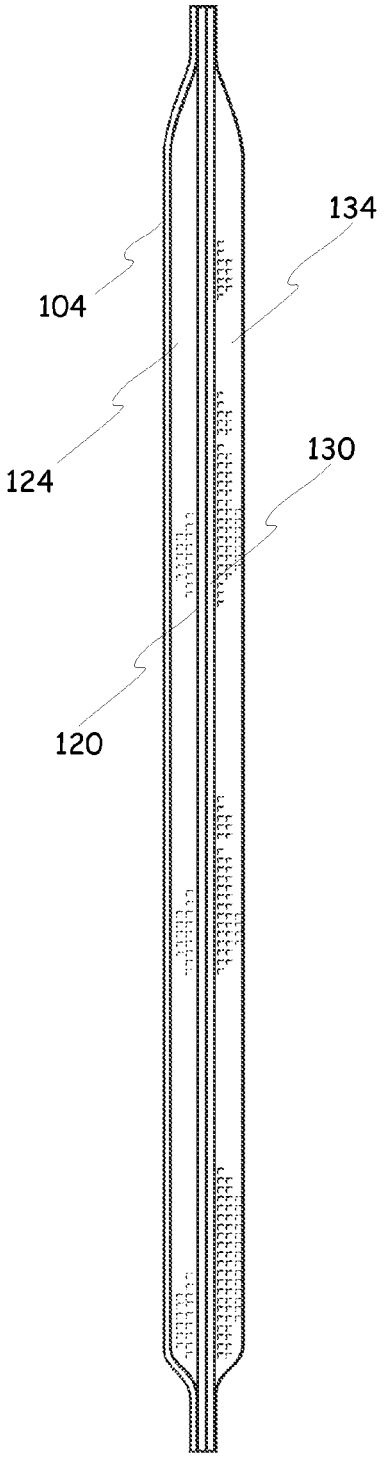
FIG. 5 is a second side elevation view of the cleaning cloth illustrated in FIG. 1.

FIG. 4 is a first side elevation view of the cleaning cloth illustrated in FIG. 1 and FIG. 5 is a second side elevation view of the cleaning cloth illustrated in FIG. 1. In FIG. 4, the front edges of the upper sheet 120 and the lower sheet 130 are visible and, the ridges 124 and 134 are also visible. Along the right side of FIG. 4, the first strip 102 is visible. In FIG. 5, the front edges of the top sheet 120 and the bottom sheet 130 are visible and, the ridges 124 and 134 are also visible. Along the left side of FIG. 5, the second strip 104 is visible.

Figure 6:
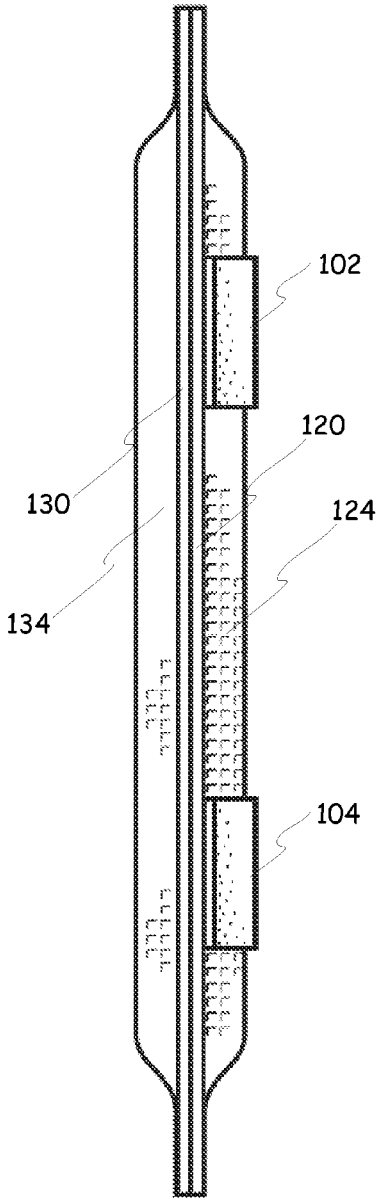
FIG. 6 is a first end elevation view of the cleaning cloth illustrated in FIG. 1.
Figure 7:
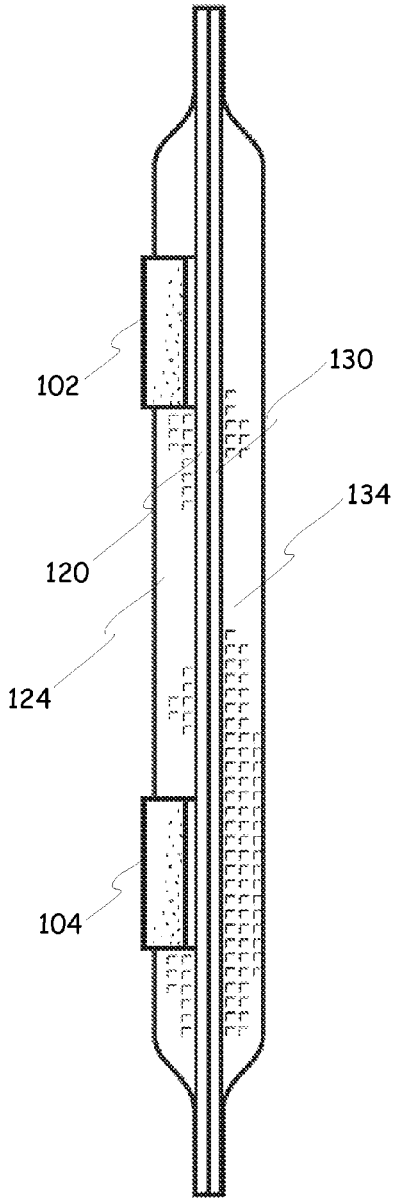
FIG. 7 is a second end elevation view of the cleaning cloth illustrated in FIG. 1.

FIG. 6 is a first end elevation view of the cleaning cloth illustrated in FIG. 1 and FIG. 7 is a second end elevation view of the cleaning cloth illustrated in FIG. 1. In these views, the edges of the top sheet 120 and the bottom sheet 130 are visible, along with the ridges 124 and 134 respectively. In both views, the first and second strip 102 and 104 are visible as the strip traverses from the interior portion 128 of the upper sheet 120, down the ridge 124 and to the ledge 126.

In the various embodiments, a variety of techniques may be used to connect the upper sheet 120 to the lower sheet 130. A few non-limiting examples include melting, gluing, thermoplastic seals, and sewing.

It should also be appreciated that although the top sheet 120 and bottom sheet 130 are illustrated as having the same length and width, in some embodiments one sheet may be larger in one or more dimensions than the other. In such embodiments, the sheets with the larger dimensions may be folded over the edges of the sheets with smaller dimensions. In addition, rather than being two distinct sheets, the structure may be formed by a single sheet that is folded over, either along the width or the length of the sheet. It should also be appreciated that in a folded embodiment, the ledge may not extend around each side of the interior portions. It should also be appreciated that the ledges 126 and 136 may be folded under or over the interior portions 128 and 138 in some embodiments. In other embodiments, the edges of the cleaning cloth may be hemmed.

In the various embodiments, the interior sheet can be made of a variety of materials. For instance, in one embodiment, the interior sheets may be fabricated from wood pulp or cotton like material. In other embodiments, the interior sheets may include a highly absorbent material. In yet other embodiments, the interior sheets may comprise an abrasive material or may be constructed with an abrasive structure. Further, in some embodiments a combination of two or more of these variations may be employed.

In some embodiments, the interior sheet may include a heat pack that when actuated, generates heat throughout the cleaning cloth to further facilitate the ability to clean. In such embodiments, the interior surfaces of the upper sheet 120 and the lower sheet 130 may be impervious to liquid, thereby keeping moisture away from the heat pack and, preventing the liquid within the heat pack from seeping out in the event that the heat pack becomes punctured.

In some embodiments, the strip may include a material that fades with use, thus providing an indication of the life span of the cleaning cloth. For example, one or more of the strips 102 and 104 may be coated with a special material that slowly fades when it is in contact with moisture. Thus, as the color fades from the strip, the user is aware that the life span of the cleaning cloth is being depleted. In other embodiments, a color strip may be included on the cleaning face of the cleaning cloth. In such embodiments, the color strip may fade due to moisture and/or fade due to abrasion. In any such embodiments, the strip is used to indicate whether or not the cleaning cloth had further life in it or, if it should be disposed of.

In some embodiments, the strips 102 and 104 may be constructed of hooks and loops to facilitate the cleaning cloth being attached to another surface. For instance, if the strips are made of hook or loop material, mating strips or surfaces constructed of loop or hook material, respectively, may be used for the other surface. In some embodiments, strips may include an adhesive material, such as tape, to allow the cleaning cloth to be attached to another surface. In such embodiments, a cover strip may be placed over the adhesive and then only removed when the cleaning cloth is ready to be used.

In another embodiment, the cleaning cloth may include the element of a lighting substance or a glowing substance in the interior cavity. For instance, the technology utilized in a lightstick may be employed within the interior of the cleaning cloth. Advantageously, such an element may facilitate the user being able to see the surface that is being cleaned and, as the glow begins to fade, the user knows that the life span of the cleaning cloth is lapsing.

A light stick is a plastic tube with a glass vial inside of it. To activate a light stick, the plastic stick is bent to break the glass vial. This allows the chemicals inside the glass vial to mix with the chemicals in the plastic tube. Once these substances contact each other, a reaction starts taking place. The reaction releases light, causing the stick to glow—this is chemiluminescence.

Thus, this technology can be employed within the interior of the cleaning cloth by including one or more light sticks within the cavity or a pocket within the cavity (such as between the absorbent cloths interior to the cavity), ensuring that the cavity or pocket is impervious to liquid and simply include the necessary chemicals and glass vials within the interior cavity. Although the light-producing reaction is not caused by heat and may not produce heat, the rate at which it occurs is affected by temperature. If a light stick is placed in a cold environment (like a freezer), then the chemical reaction will slow down. Less light will be released while the light stick is cold, but the stick will last much longer. On the other hand, if a light stick is immersed in hot water, the chemical reaction speeds up. The stick will glow much more brightly, but will wear out faster too.

There are three components of a light stick—two chemicals that interact to release energy and also a fluorescent dye to accept this energy and convert it into light. Although there is more than one recipe for a light stick, a common commercial light stick uses a solution of hydrogen peroxide that is kept separate from a solution of a phenyl oxalate ester together with a fluorescent dye. The color of the fluorescent dye is what determines the resulting color of the light stick when the chemical solutions are mixed. The basic premise of the reaction is that the reaction between the two chemicals releases enough energy to excite the electrons in the fluorescent dye. This causes the electrons to jump to a higher energy level and then fall back down and release light.

Specifically, the chemical reaction works like this: The hydrogen peroxide oxidizes the phenyl oxalate ester, to form phenol and an unstable peroxyacid ester. The unstable peroxyacid ester decomposes, resulting in phenol and a cyclic peroxy compound. The cyclic peroxy compound decomposes to carbon dioxide. This decomposition reaction releases the energy that excites the dye.

In some embodiments, the interior a cavity defined by the inner surface of the top sheet 120 and the bottom sheet 130 may be impregnated with cleaning solution. Thus, when the cleaning cloth is used, the cleaning solution seeps out through the top sheet 120 and/or bottom sheet 130 and is applied to a surface to be cleaned. In other embodiments, various scents, perfumes, odor emitting crystals, etc. may be placed into the cavity.

In some embodiments, the strips 102 and 104 are utilized to connect the cleaning cloth to another surface, such as a mop head, a hand held handle, a robo-cleaner, a bottom surface of a vacuum cleaner, or the like. In other embodiments, the strips may serve as scrubbing strips to help facilitate the cleaning of a surface. In yet another embodiments, the strips may be multi-purpose being used for connecting the cleaning cloth to another surface and also used for scrubbing, depending on the orientation of the cleaning cloth and the actual usage.

In FIG. 1 and FIG. 3, the strips 102 and 104 are shown as being inset from the edge of the interior portion 128. However, in other embodiments, the strips could be located on the longitudinal ledge, the side ledge or both.

Figure 8:
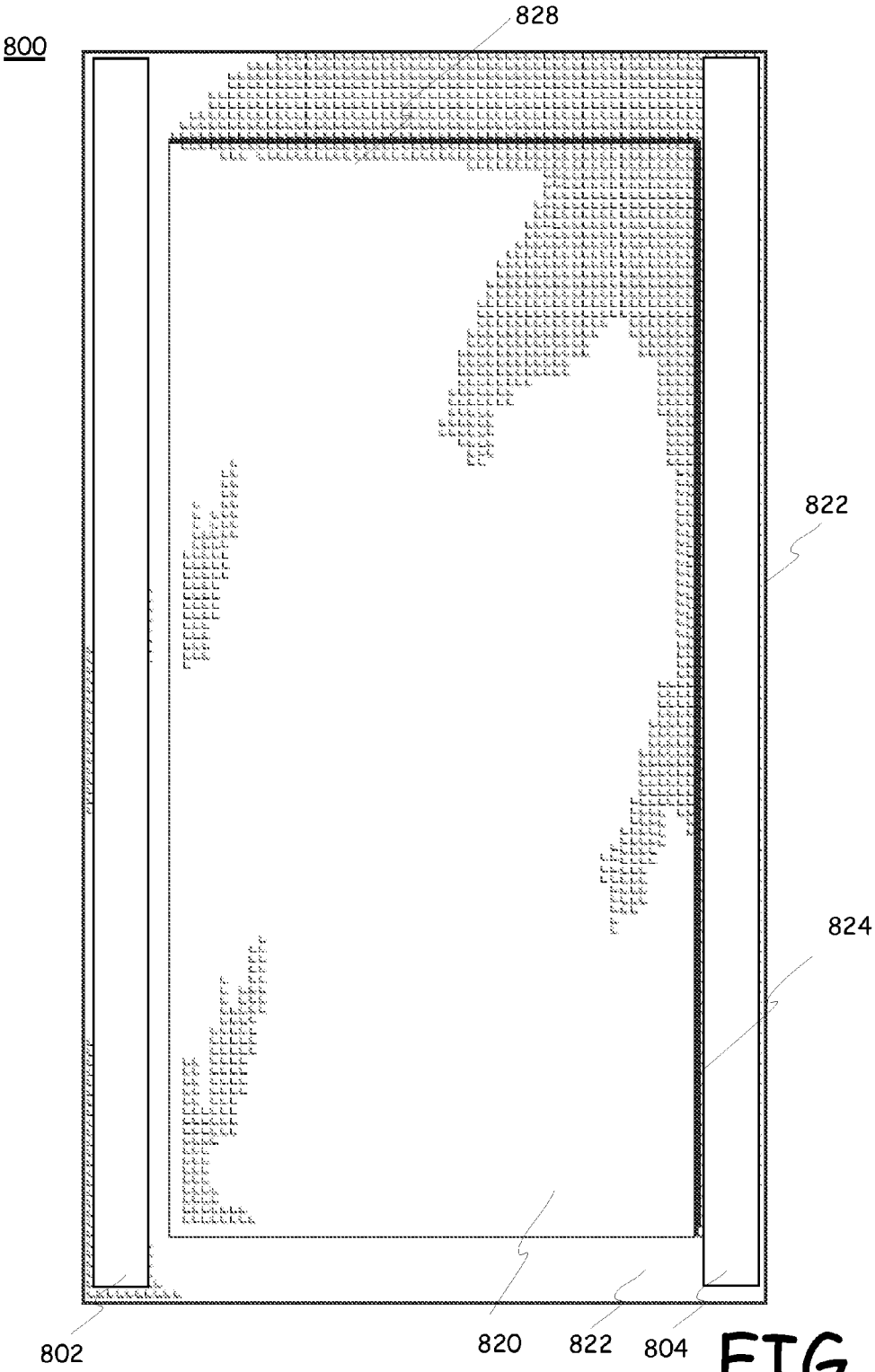
FIG. 8 illustrates one side of an embodiment of the cleaning cloth that includes strips on the ledge of the cleaning cloth.

FIG. 8 illustrates one side of an embodiment of the cleaning cloth that includes strips on the ledge of the cleaning cloth. In the illustrated embodiment, cleaning cloth 800 is constructed similar to the embodiment illustrated in FIGS. 1-7 with the exception that the strips 802 and 804 are located on the ledge 822 of the cleaning cloth 800. The strips are illustrated as being positioned along the longitudinal ledge. In operation, the strips 802 and 804 can be attached to a surface, such as a mop head or sweeper head (not shown), which includes an offset surface for mating with the strips 802 and 804. In such an embodiment, the entire surface of the interior portion 828 would be free from the strips. Thus, the entire surface 828 of the cleaning cloth 800 could be used to clean a target surface.

It should also be appreciated that in such embodiments, the strips may be included on the top sheet and the bottom sheet of the cleaning cloth 800. As such, the side illustrated in FIG. 8 could represent both sides of the cleaning cloth. By selecting interior sheets that cause the ridge 824 of the cleaning cloth to rise to a sufficient height such that the surface of the interior portion 828 is further extended from a plane existing through the interior of the cleaning cloth and parallel with the top and bottom sheets. Thus, the interior surface 828 of the top and bottom sheet 820 would be in contact with the surface to be cleaned but, the strips 802 and 804 located within the ledge 822 would not come in contact with the surface to be cleaned during normal use. Once the interior surface 828 of one side of the cleaning cloth is soiled, the cleaning cloth can be turned over and the strips 802 and 804 located on the ledge 822 of the other side can be attached to the cleaning implement. At this point, the interior surface 828 of the other side of the cleaning cloth can then be used to clean the desired surface. Thus it will be appreciated that such an embodiment of the cleaning cloth provides a two-sided cleaning cloth.

It should also be appreciated that although the ledges 822 of the cleaning cloth do not normally come into contact with the surface to be cleaned in some embodiments, in other embodiments, the cleaning implement can be constructed such that the surface of the ledge 822 could be pressed against the surface to be cleaned. In such an embodiment, the strips 802 and 804 on one side of the cleaning cloth could be structured in such a manner that the surface of the strip is naturally abrasive. For instance, the strips 802 and 804 can be structured or modified to include protrusions, apertures or other surfaces that can be used to scrub the target surface. In other embodiments, the strip may be constructed of an abrasive material. In yet other embodiments, the strip may be structured so as to be abrasive and include an abrasive material.

The inclusion of abrasive material as the strip or within the strip may include materials similar to those used for making scouring pads, typically polymers or polymer blends with or without specific abrasives. Examples of suitable polymers include thermoplastic polymers such as polypropylene, high density polyethylene, polyesters (eg., polyethylene terephthalate), nylon, polystyrene, polycarbonate, and blends and copolymers thereof.

An alternative to using materials found in typical scouring pads is to use brushes containing bristles to achieve scrubbing. Such bristles are typically composed of polymer or polymer blends, with or without abrasives. In the context of brushes, bristles made of nylon may be used because of rigidity, stiffness, and/or durability. Other materials may also be used.

Another approach is to use netting or scrim materials to form the scrubbing strip. Again, the netting or scrim is typically composed of a polymer or polymer blend, either with or without abrasives. The netting or scrim is typically wrapped around a secondary structure to provide some bulk. The shape of the holes in the netting can include, but is not limited to, a variety of shapes such as squares, rectangles, diamonds, hexagons or mixtures thereof. Typically, the smaller the area composed by the holes in the netting the greater the scrubbing ability. This is primarily due to the fact that there are more points where the scrim material intersects, as it is these intersection points that will contact the floor. An alternative to wrapping netting or scrim is to apply molten extruded polymers directly onto a secondary structure such as a non-woven. Upon solidifying the polymer would create high point stiffer material as compared to the secondary non-woven, and thereby provides scrubbing ability. In some embodiments, melamine foam can be used as the scrubbing strip.

Those skilled in the art will appreciate that a wide variety of other structures may be used to create a strip that is able to operate as a scrubbing strip.

Thus, in some embodiments, the strips on one side of the cleaning cloth 800 may be best suited for attachment to the cleaning implement while the strips on the other side of the cleaning cloth may be best suited for scrubbing. However, in other embodiments, the strips maybe constructed such that they are suitable both for scrubbing and attachment. In yet other embodiments, the strips can be attached on the longitudinal edges that are more suitable for scrubbing and on the side or lateral edges that are more suitable for attachment, and visa versa.

Figure 9:
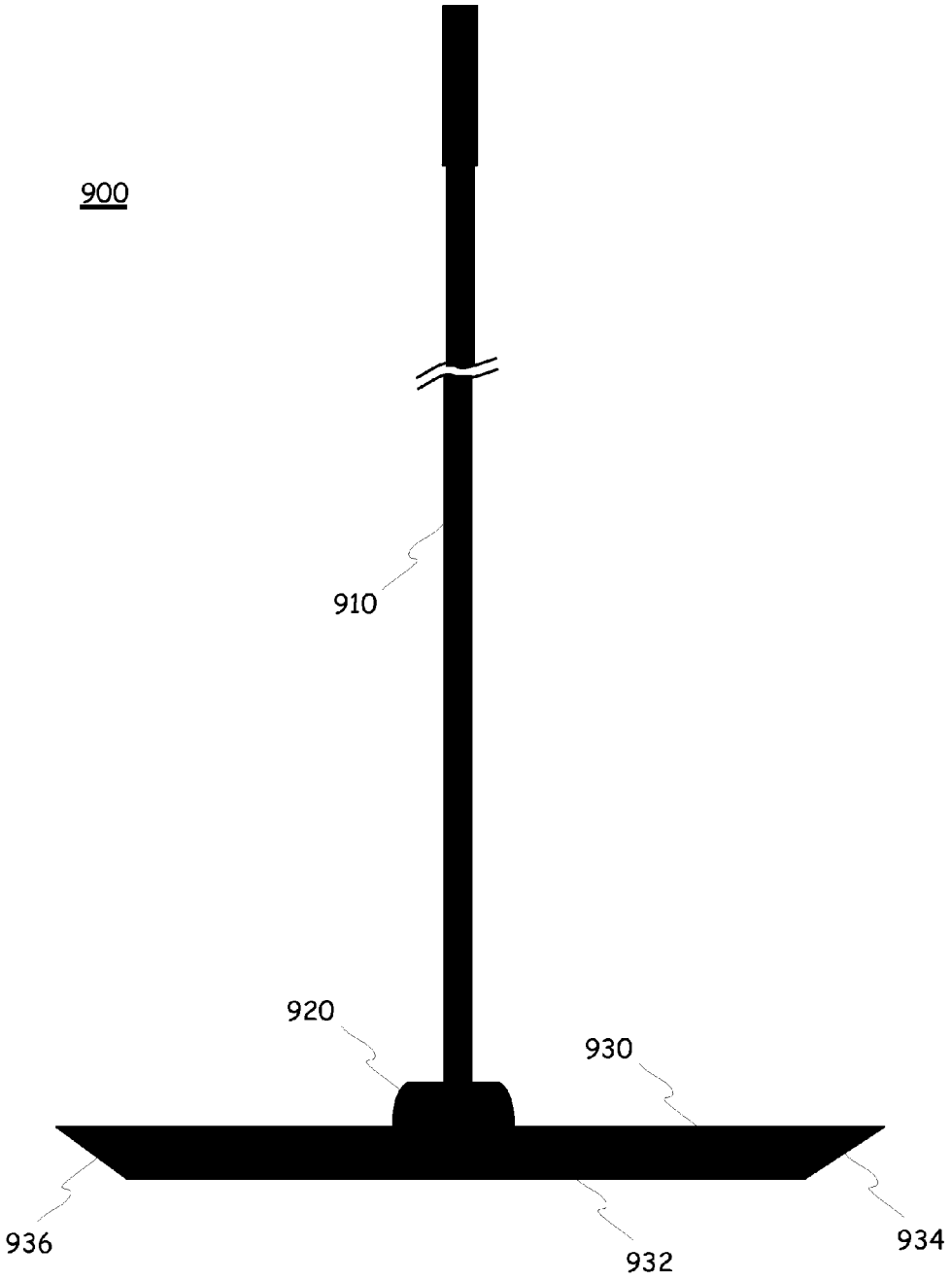
FIG. 9 is a non-limiting example of a cleaning element that could be used for various embodiments of the cleaning cloth but that most suitably illustrates the use of the embodiment of the cleaning cloth illustrated in FIG. 8.

FIG. 9 is a non-limiting example of a cleaning element that could be used for various embodiments of the cleaning cloth but that most suitably illustrates the use of the embodiment of the cleaning cloth illustrated in FIG. 8. In the illustrated embodiment, the cleaning implement 900 includes a handle 910, a pivoting, semi-rigid, adjustable or rigid connection 920 and a head 930. The head 930 includes a primary surface 932 which corresponds to the interior portion 828 of the cleaning cloth 800, and two beveled side edges 934 and 936 which correspond to the ledges 824 of the cleaning cloth 800. The beveled side edges 934 and 936 are configured such that they can receive and attach to the strips 802 and 804 located on the cleaning cloth 800. In addition, in embodiments in which the strips on the opposing side are suitable for scrubbing, by leaning or tilting the head 930, force can be applied to the scrubbing strip to clean highly soiled areas of the target surface. The beveled edges may be included on the longitudinal edges, latitudinal (short) edges, or a combination of both. The beveled edge may only exist on one edge of the head 930 or two or more edges. The handle 910 can be constructed such that it pivots at connection point 920 to allow ease on reaching and cleaning the target surface but, when the user needs to scrub a spot, the handle can be fixed in position to force the beveled edge against the surface. This can be accomplished in a variety of manners. A few non-limiting examples include a latching mechanism, a structural mechanism that allows the handle to rotate only in a 270 degree range, or approximately 270 degrees, but when forced in the direction of the beveled edge, will not rotate or pivot and thus, allows the user to apply force with the beveled edge. In other embodiments, it should be appreciated that rather than beveled, the edges may be curved, arched, perpendicular, textured, etc.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A cleaning device comprising:

at least one top said sheet having a length and a width;

at least one bottom sheet having a length and width corresponding to the length and width of the at least one top sheet and is stacked with the at least one top sheet such that the edges of the at least one top sheet and the at least one bottom sheet are in alignment;

the at least one top sheet and the at least one bottom sheet being joined together to form an interior cavity;

at least two interior sheets being inserted into the cavity wherein the at least two interior sheets have a length and width that is less than the length and width of the at least one top sheet and wherein said interior sheets consists of an absorbent material formed from an absorbent air-laid substrate, substantially made of cellulosic wood pulp fibers;

the at least two interior sheets causing an interior portion of the at least one top sheet and an interior portion of the at least one bottom sheet to be defined by a ridge that transitions to a ledge extending from the edges of the at least two interior sheets towards the edges of the at least one top sheet and the at least one bottom sheet wherein proximate to an outer surface of the at least one top sheet comprises a woven material that can be used to secure the cleaning device to a cleaning head of a cleaning element.

2. The cleaning device of claim 1, wherein at least one surface of the cleaning device has a uniformly textured surface.

3. The cleaning device of claim 1, wherein the total basis weight of the absorbent material of the at least two interior sheets is from about 200 grams to about 400 grams per square meter.

4. The cleaning device of claim 3, wherein the length and width of the at least two interior sheets are equal.

5. The cleaning device of claim 3, wherein the at least two interior sheets have the same thickness.

6. The cleaning device of claim 1, wherein the at least two interior sheets have the same thickness.

7. The cleaning device of claim 1, wherein the woven material comprises one or more strips that can be used for attaching the cleaning device to thea cleaning head of the cleaning element.

8. The cleaning device of claim 7, wherein the one or more strips are positioned such that they cover at least a portion of the interior portion of the top sheet.

9. The cleaning device of claim 7, wherein the one or more strips are positioned such that they cover at least a portion of the ledge.

10. The cleaning device of claim 9, wherein at least one additional strip is positioned such that it covers at least a portion of the ledge of the at least one bottom sheet, wherein the at least one additional strip is suitable for scrubbing.

11. The cleaning device of claim 1, wherein the woven material comprises one or more strips that can be used for attaching the cleaning device to the cleaning head of the cleaning element and the at least one bottom sheet of the cleaning device includes two strips positioned on the ledge and are suitable for attachment to the cleaning head of the cleaning element and are suitable for scrubbing.

12. The cleaning device of claim 1, wherein the woven material comprises two strips that can be used for attaching the cleaning device to the cleaning head of the cleaning element and are also suitable for scrubbing and the at least one bottom sheet includes two strips positioned such that they cover at least a portion of the ledge of the at least one bottom sheet and the strips are suitable for attachment to the cleaning head of the cleaning element and are also suitable for scrubbing.

13. The cleaning device of claim 1, wherein the woven material comprises two strips positioned such that they cover at least a portion of the ledge of the at least one top sheet and that can be used for attaching the cleaning device to the cleaning head of the cleaning element and are also suitable for scrubbing, and the at least one bottom sheet of the cleaning device includes two strips positioned such that they cover at least a portion of the ledge of the at least one bottom sheet and the strips are suitable for attachment to a cleaning head and are suitable for scrubbing.

14. A cleaning element in combination with the cleaning device of claim 11.

15. A cleaning device comprising:

at least one top sheet and at least one bottom sheet that are stacked such that the edges of the at least one top sheet and the at least one bottom sheet are in alignment;

the at least one top sheet and the at least one bottom sheet being joined together to form an interior cavity;

at least two interior sheets being inserted into the interior cavity, wherein the at least two interior sheets have a length and width that is less than a length and width of the at least one top sheet and, wherein said interior sheets consists of an absorbent material formed from an absorbent air-laid substrate, substantially made of cellulosic wood pulp fibers;

the at least two interior sheets causing an interior portion of the at least one top sheet to be defined by a ridge that transitions to a ledge extending from the edges of the at least two interior sheets towards the edges of the at least one top sheet and the at least one bottom sheet wherein a surface of at least one of the at least one top sheet and the at least one bottom sheet of the cleaning device comprising a woven material suitable for being attached to a cleaning element.

16. A cleaning device comprising:

at least a first sheet and at least a second sheet that are stacked such that the edges of the at least first sheet and the at least second sheet are in alignment;

the at least first sheet and the at least second sheet being joined together to form an interior cavity;

at least two interior sheets being inserted into the cavity wherein the at least two interior sheets have a length and width that is less than a length and width of the at least first sheet and, wherein said interior sheets consists of an absorbent material formed from an absorbent air-laid substrate, substantially made of cellulosic wood pulp fibers;

the at least two interior sheets causing an interior portion of the at least first sheet to be defined by a ridge that transitions to a ledge extending from the edges of the at least two interior sheets towards the edges of the at least first sheet and the at least second sheet wherein a woven attachment material is attached proximate to the at least first sheet or the at least second sheet.

* * * * *